US007533947B2

(12) United States Patent
Kim et al.

(10) Patent No.: US 7,533,947 B2
(45) **Date of Patent: *May 19, 2009**

(54) REFRIGERATOR

(75) Inventors: Sang Oh Kim, Seoul (KR); Kyung Han Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 381 days.

This patent is subject to a terminal disclaimer.

(21) Appl. No.: 11/282,466

(22) Filed: Nov. 21, 2005

(65) Prior Publication Data

US 2006/0242988 A1 Nov. 2, 2006

(30) Foreign Application Priority Data

Apr. 19, 2005 (KR) ..... 10-2005-0032370

(51) Int. Cl.
*A47B 96/04* (2006.01)
*A47B 88/00* (2006.01)

(52) U.S. Cl. ..... 312/402; 312/327; 312/330.1

(58) Field of Classification Search ..... 312/327, 312/328, 294, 295, 296, 298–311, 271, 272, 312/270.1, 270.2, 270.3, 312, 402, 330.1–334.47
See application file for complete search history.

(56) References Cited

U.S. PATENT DOCUMENTS 748,702 A * 1/1904 Conary ..... 187/400
2,473,125 A * 6/1949 Alexander ..... 187/400
2,497,734 A * 2/1950 Kuklich ..... 312/312
2,504,635 A * 4/1950 Bradley ..... 16/223
2,614,020 A * 10/1952 Collins ..... 312/312
3,920,101 A * 11/1975 Richards ..... 108/42
3,982,801 A * 9/1976 Heidorn et al. ..... 312/306
4,065,194 A * 12/1977 Mattia ..... 312/247
4,091,906 A * 5/1978 Clarke et al. ..... 192/129 A
4,568,132 A * 2/1986 Watt ..... 312/312
4,790,611 A * 12/1988 Craner ..... 312/306
5,273,352 A * 12/1993 Saper ..... 312/7.2
5,322,365 A * 6/1994 Teufel et al. ..... 312/330.1
5,429,043 A * 7/1995 Becker ..... 99/448
5,607,212 A * 3/1997 Kilpatrick ..... 312/237
2005/0073225 A1 4/2005 Kwon et al.

FOREIGN PATENT DOCUMENTS

JP 5-296647 A 11/1993
KR 1998-026269 A 7/1998

OTHER PUBLICATIONS

English translation for Japanese Patent JP 05-296647, Nov. 2006.*

* cited by examiner

*Primary Examiner*—Janet M Wilkens
*Assistant Examiner*—Timothy M Ayres
(74) *Attorney, Agent, or Firm*—Birch, Stewart, Kolasch & Birch, LLP

(57) ABSTRACT

Refrigerator which permits the user to taking out food conveniently by moving up a container therein, and in which panels are provided on opposite sides of the container to pivot when the container moves in the vertical direction, for preventing injury to the user at the time the container moves up/down.

21 Claims, 8 Drawing Sheets

REFRIGERATOR

CROSS-REFERENCE TO RELATED APPLICATION

This Nonprovisional Application claims priority under 35 U.S.C. §119(a) on Patent Application No. 10-2005-0032370 filed in Korea on Apr. 19, 2005, the entire contents of which are hereby incorporated by reference.

BACKGROUND OF THE INVENTION

1. Field of the Invention

The present invention relates to a refrigerator, and more particularly, to a refrigerator having a safety device to protect the user from injury due to the movement of the container.

2. Discussion of the Related Art

In general, the refrigerator is a home appliance for storing food at a low temperature by operating a refrigerating system. A related art refrigerator will be described with reference to FIGS. 1 and 2. Referring to FIGS. 1 and 2, the related art refrigerator is provided with upper, and lower storage chambers 22 and 23 in a body 11 thereof. The lower storage chamber 31 has an opening in front of the body, and the upper storage chamber 21 and the lower storage chamber 31 have an upper door 23 and a lower door 33 mounted thereon respectively for opening/closing the respective storage chambers. There is a machinery room 13 at a lower portion of the body 11 for mounting a compressor 15, and the like.

The upper door 23, which opens/closes a front opening of the upper storage chamber 21, includes one pair of left, and right side doors, each rotatably mounted on the body. The lower door 33 slides in the front/rear direction of the body 11 to open/close the lower storage chamber 31 in a drawer fashion.

For sliding of the lower door 33, there are rails 37 mounted both on opposite sides of a lower portion of the body 11 and opposite back sides of the lower door 33 for sliding and extending in the front/rear direction, and a container 35 of a box shape with an open top behind the door 33 for holding food. The container 35 is opened/closed as the container 35 slides in the front/rear direction with the lower door 33.

However, the related art refrigerator has the following problems. In a case the container is mounted at a lower portion of the body, since a position of the container is low, the user has to lower his/her position by bending or squatting down to put in or take out food. Particularly, because the user is required to bend his/her body to find, and take out a desired piece of food from many pieces of food, the longer the user bends his/her body, the more harmful to the user's health.

SUMMARY OF THE INVENTION

Accordingly, the present invention is directed to a refrigerator that substantially obviates one or more problems due to limitations and disadvantages of the related art.

An object of the present invention is to provide a refrigerator which enables a user to put food in or take out food/from a container without bending oneself to the container.

Another object of the present invention is to provide a refrigerator which can prevent a container moving structure from injuring the user.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a refrigerator includes a body having a storage space therein; a door slidably movable with respect to the body; at least one rail arranged on the door for slidably guiding the door; a container arranged in the storage space, a gap being between the container and the rail; a moving unit for moving the container in a vertical direction; and a safety device covering the gap.

In another aspect of the present invention, a refrigerator includes a body having a storage space therein; a door slidably movable with respect to the body; at least one rail arranged on the door for slidably guiding the door; a container arranged in the storage space, a gap being between the container and the rail; a moving unit for moving the container in a vertical direction; and a safety device covering the gap between the container and the rail when the container moves in the vertical direction, and for covering a top of the container when the container moves down, the safety device having at least one thorough hole for passing cold air into the container.

In another aspect of the present invention, a refrigerator includes a container movable in a first direction and a second direction; a door for moving the container in the first direction; at least one rail located on the door for slidably guiding the door in the first direction, a gap being between the container and the rail; and a safety device covering the gap.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE ILLUSTRATED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

A refrigerator in accordance with a preferred embodiment of the present will be described with reference to FIG. 3. It should be noted that the moving unit 200 in the illustrated embodiment is a lifting unit for moving the container 130 in the vertical direction. However, the present invention can also apply to a moving system for moving the container 130 in other directions.

Figure 1:
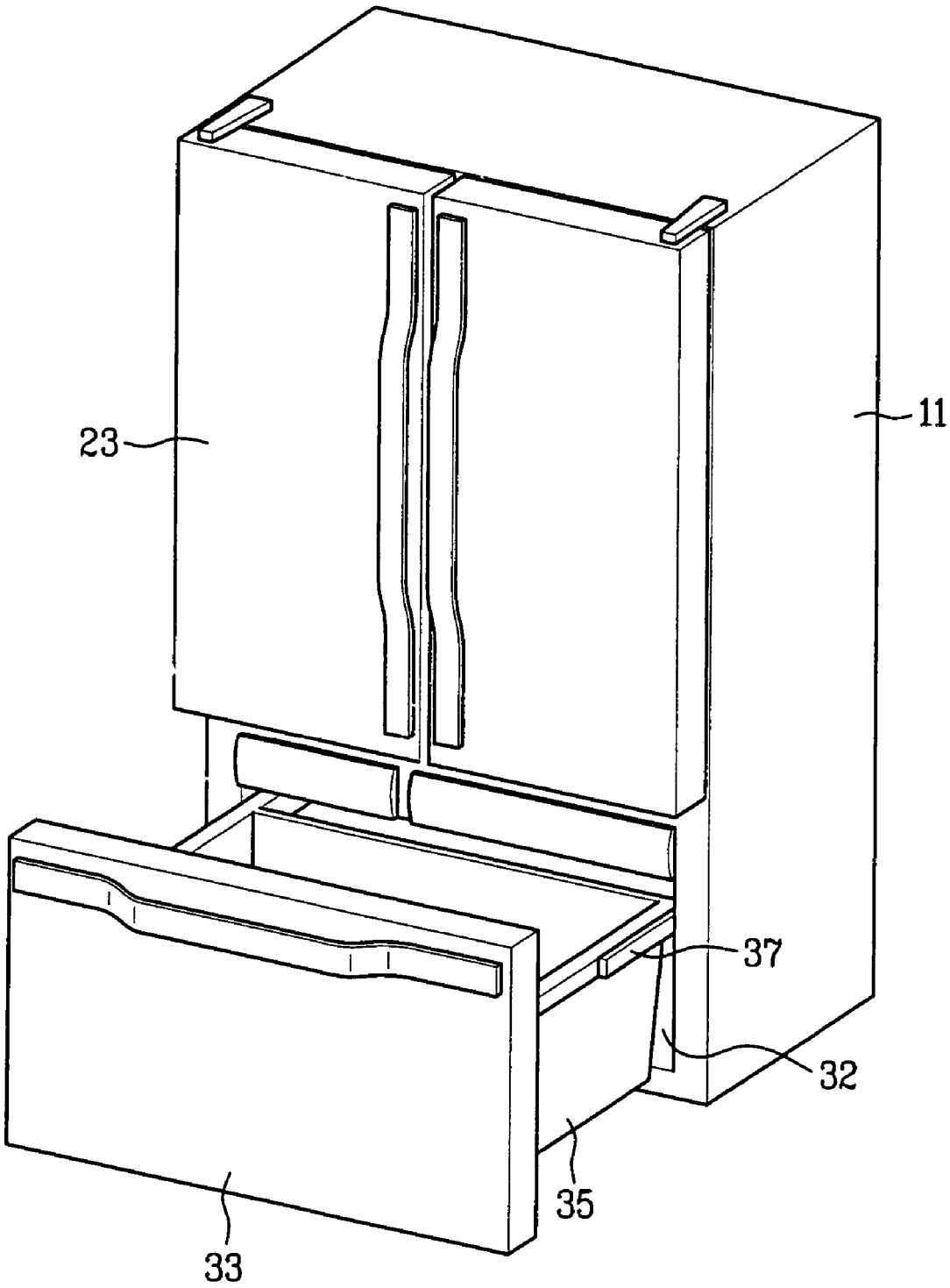
FIG. 1 Related Art
FIG. 1 illustrates a perspective view of a related art refrigerator.
Figure 2:
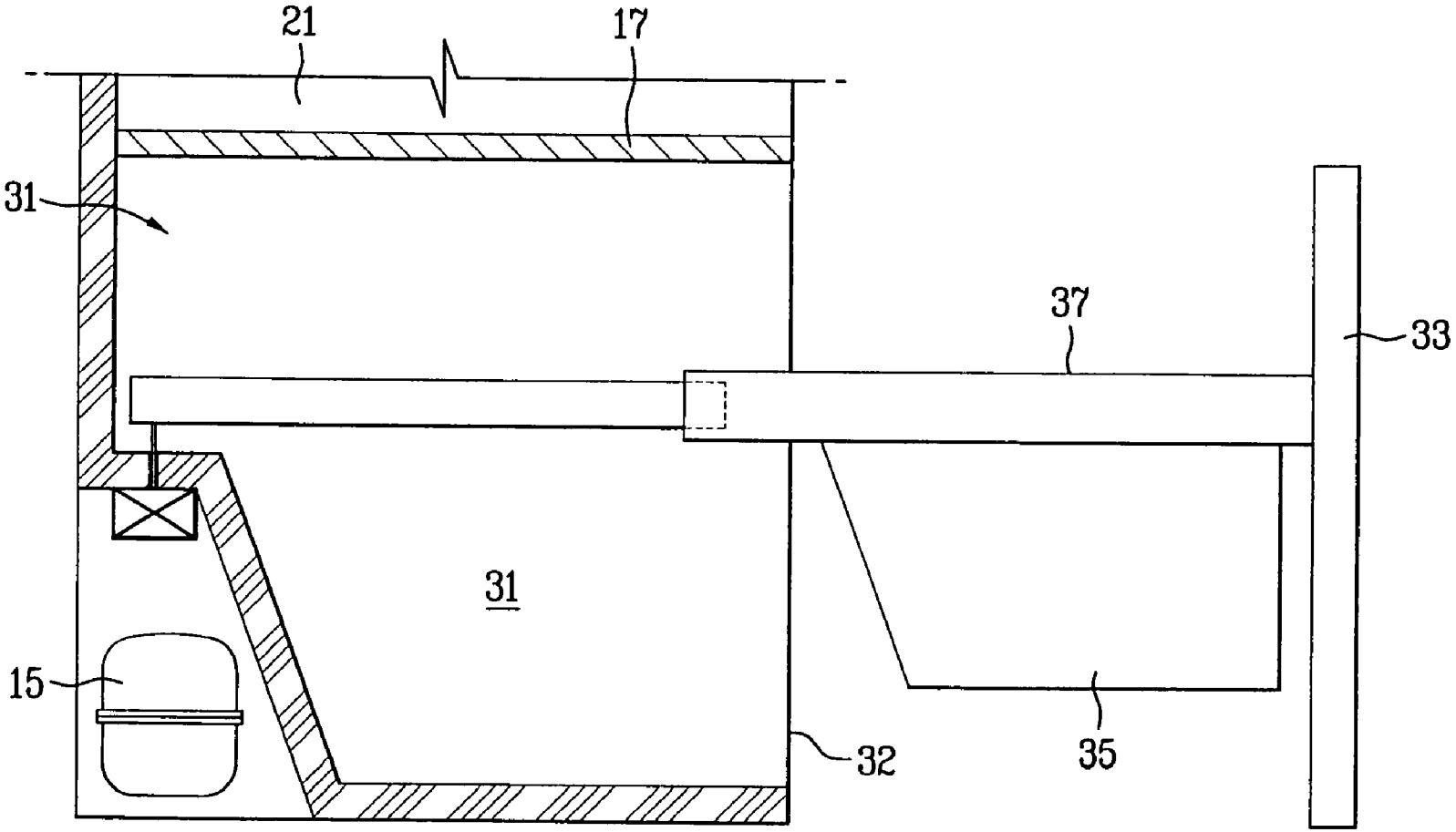
FIG. 2 Related Art
FIG. 2 illustrates a perspective view showing an opened state of the lower storage chamber of the refrigerator in FIG. 1.
Figure 3:
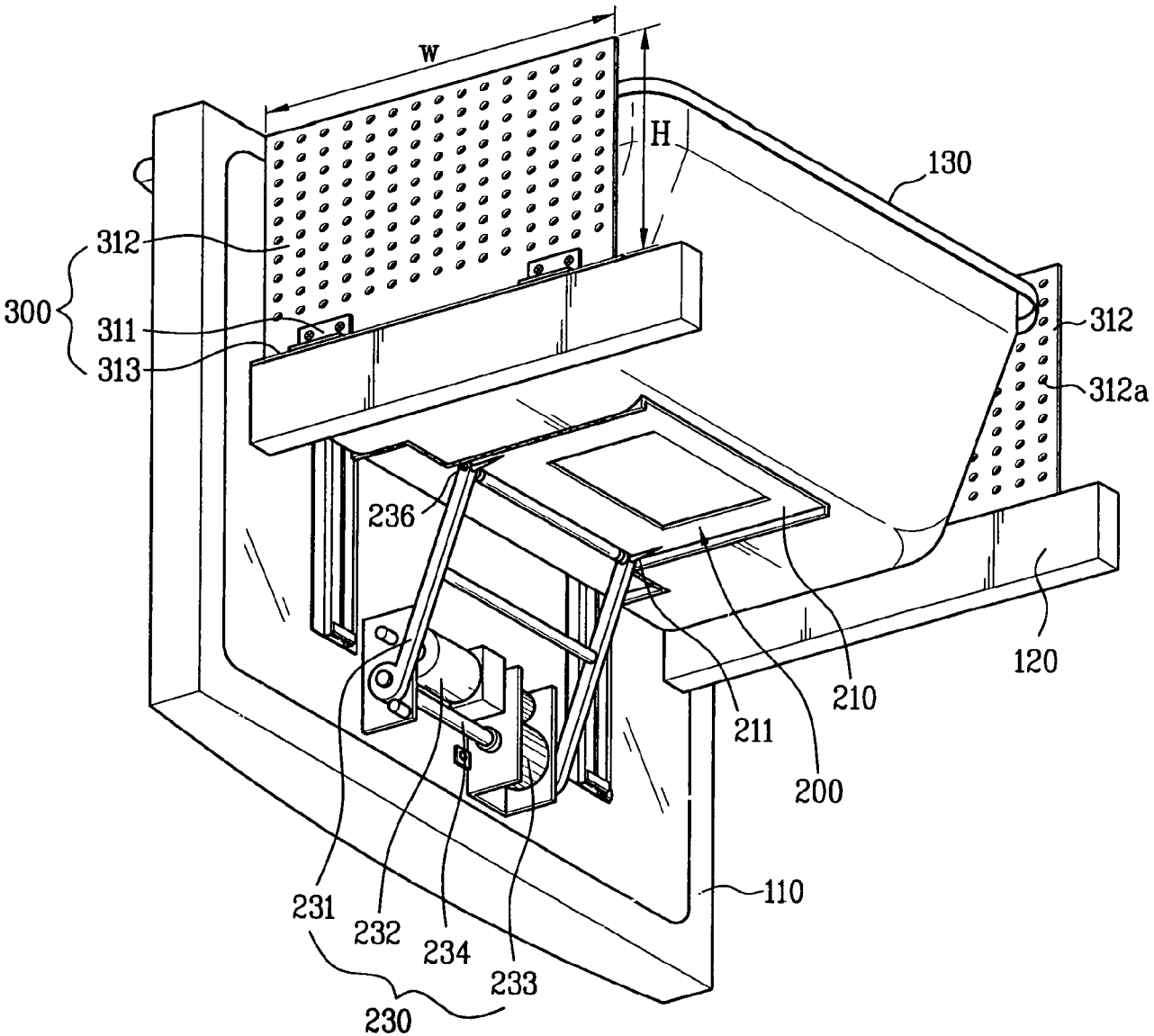
FIG. 3 illustrates a perspective view of a back side of a lower door of a refrigerator in accordance with a preferred embodiment of the present invention.
Figure 4:
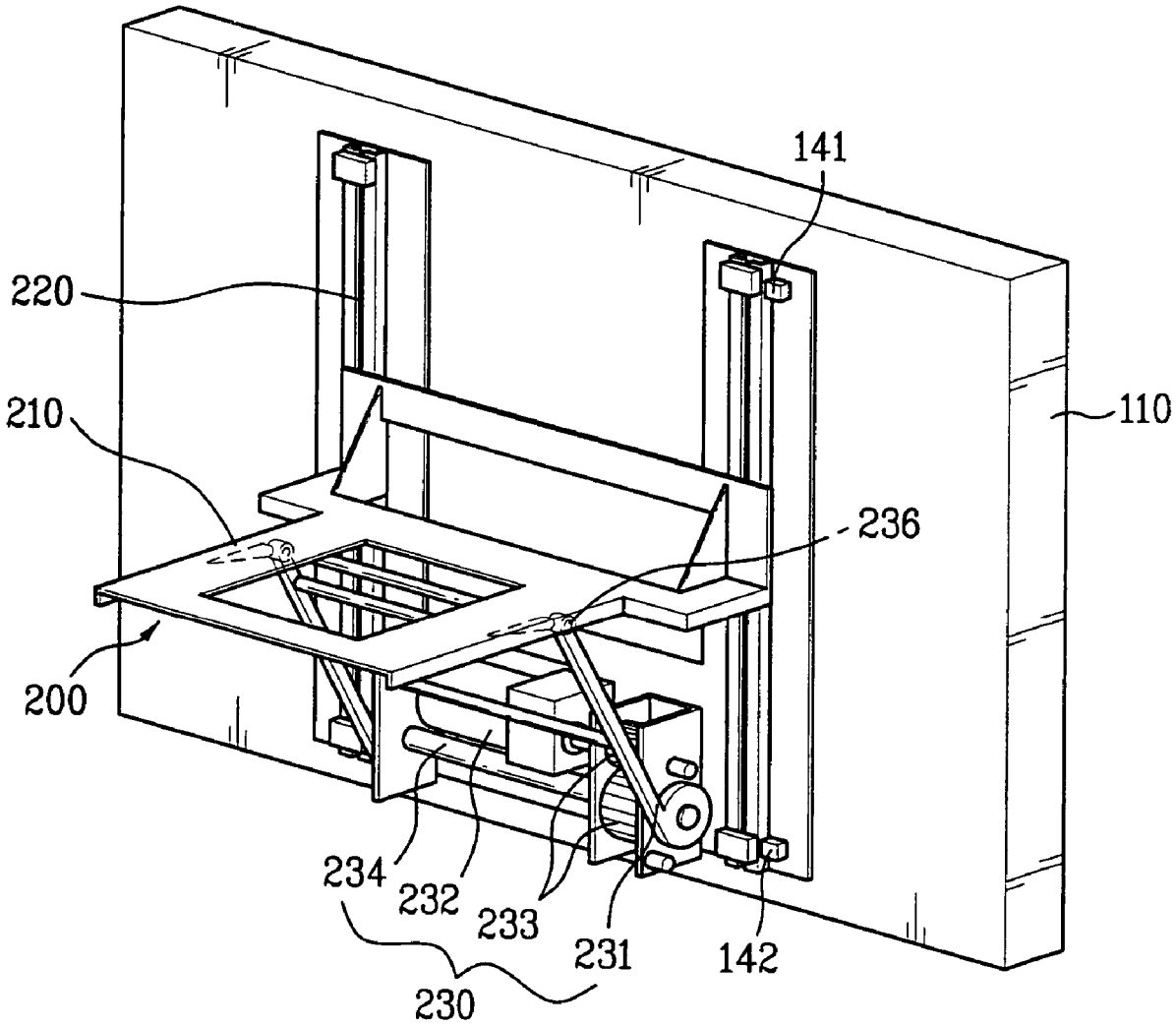
FIG. 4 illustrates a perspective view of the lifting unit in FIG. 3.

Referring to FIG. 3, the refrigerator includes a body 11 (see FIG. 1) having a storage chamber 31 (see FIG. 1), a door 110 slidably mounted to the body for opening/closing a front opening of the body, rails 120 on the door for slidably guiding the door, a container 130 arranged in the storage space, a lifting unit 200 for moving up/down the container, and a safety device 300 pivotably connected to the rail.

The refrigerator has the storage chamber 31, to which the door 110 is mounted for sliding, and opening/closing the storage chamber. The container 130 is applicable to a refrigerator having one or more storage chambers.

In an embodiment, a control panel (not shown) is mounted on the front of the door 110 for moving up/down the container 130. The control panel preferably has buttons for selecting moving up/down the lifting unit 200. Moreover, the lifting unit may be designed to move up automatically when a predetermined time period passes in a open-door state. In this case, the control panel may have a moving down button only.

The rails 120 are slidably mounted on opposite sides of the door 110 for sliding movement of the door 110 with respect to the body of the refrigerator. In an embodiment, the rail 120 has two or more members, each of which has substantially a "⊂" shape to form an extendable structure. Other rail structures may be used as far as the rails are extendable when the door is opened/closed.

The container 130 is mounted to a backside of the door 110, such that the container 130 is movable up/down when the door 110 is drawn out completely. The lifting unit 200 is mounted for moving up/down the container 130. The lifting unit 200 includes a lift 210 for seating and supporting the container 130 thereon, a guide member 220 on the backside of the door 110 for guiding the movement of the lift 210 in the vertical direction, and a lifting apparatus 230 for moving the lift 210 up/down.

In the illustrate embodiment, the lift 210 has substantially a "└" shape, for supporting of the underside of the container 130 on which a load of the container acts and the front side of the container 130 on which the load of the container acts when the container is tilted. The lift 210 may also be designed to support opposite sides, front and rear, or a top of the container.

The lifting apparatus 230 includes driving arms 231 mounted on a lower portion of the door 110 to be rotatable in an up/down direction, a driving motor 232 at a middle of the lower portion of the door 110, a gear unit 233 rotatably coupled to the driving motor 232 with a shaft, and a driving shaft 234 rotatably connected to the gear unit 233. The driving shaft 234 has opposite ends connected to the driving arms 231 for rotating the driving arms 231. The driving motor 232 also operates under the control of a main control unit (not shown) or a separate driving motor control PCB (not shown).

It is preferable that there are two or more driving arms 231 for securely supporting the underside of the container. Each of the driving arms 231 has a roller 236 at an end for rolling along the underside of the lift 210. There are sloped move-down preventive steps 211 on the underside of the lift 210 to prevent the lift 210 from moving down once the lift is lifted by the driving arms 231.

It should be noted that the foregoing lifting unit 200 is just an embodiment to illustrated the present invention and should not be used to limit the scope of the present invention. Other structures of the moving/lifting unit 200 may be used as far as the moving unit 200 can move the container 130.

For example, a rack and pinion system may be used as the lifting unit. The lifting unit moves up/down together with the container. In this instance, the rack is fixedly secured to the door vertically, and the pinion is coupled to a motor with a shaft, and therefore moves up/down along the rack. Accordingly, when the motor rotates, the pinion moves up/down along the rack, to make the container to move up/down. In this instance, the motor may be mounted to be movable with the lift assembly.

Moreover, a ball screw system can be employed as the lifting unit. The ball screw is secured to the door vertically, for moving up/down the container as the ball screw rotates. In this structure, the driving motor only rotates the ball screw, but the driving motor is fixed such that the driving motor does not move up/down.

The door 110 has a top sensor 141 and a bottom sensor 142 mounted thereon to set the highest and lowest positions of the lift 210. The top sensor 141 and the bottom sensor 142 are connected to the control panel, electrically.

Figure 7:
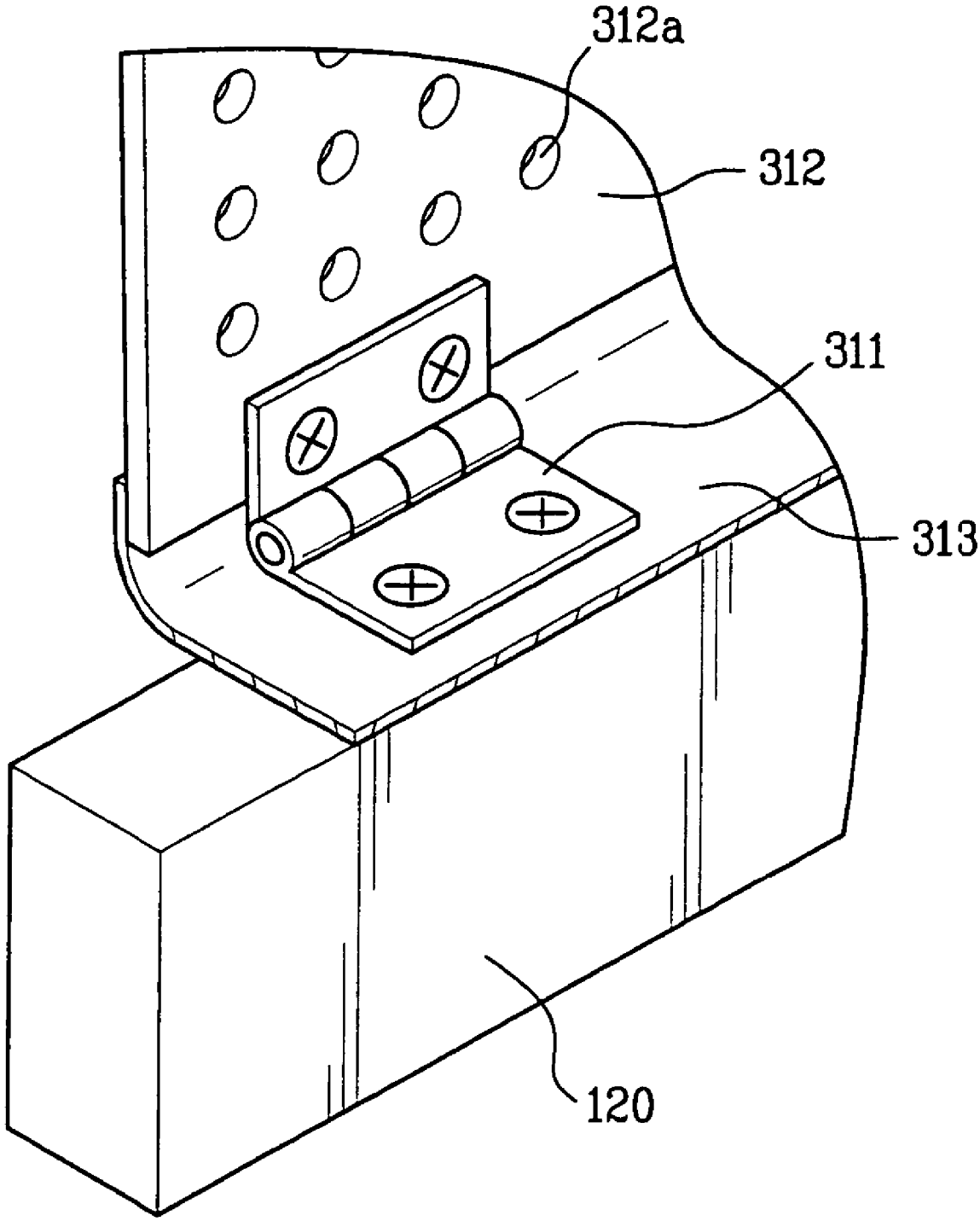
FIG. 7 illustrates a perspective view of the panel and the rail in FIG. 3.

The safety device 300 is provided for preventing object(s) from being inserted between the rails 120 and the container 130. The safety device 300 includes hinges 311 pivotably secured to the rails respectively, and a panel 312 fastened to the hinge for pivoting as the container moves up. In the illustrated embodiment, the hinge is fastened to a top surface of the rail as shown in FIG. 7.

Figure 6:
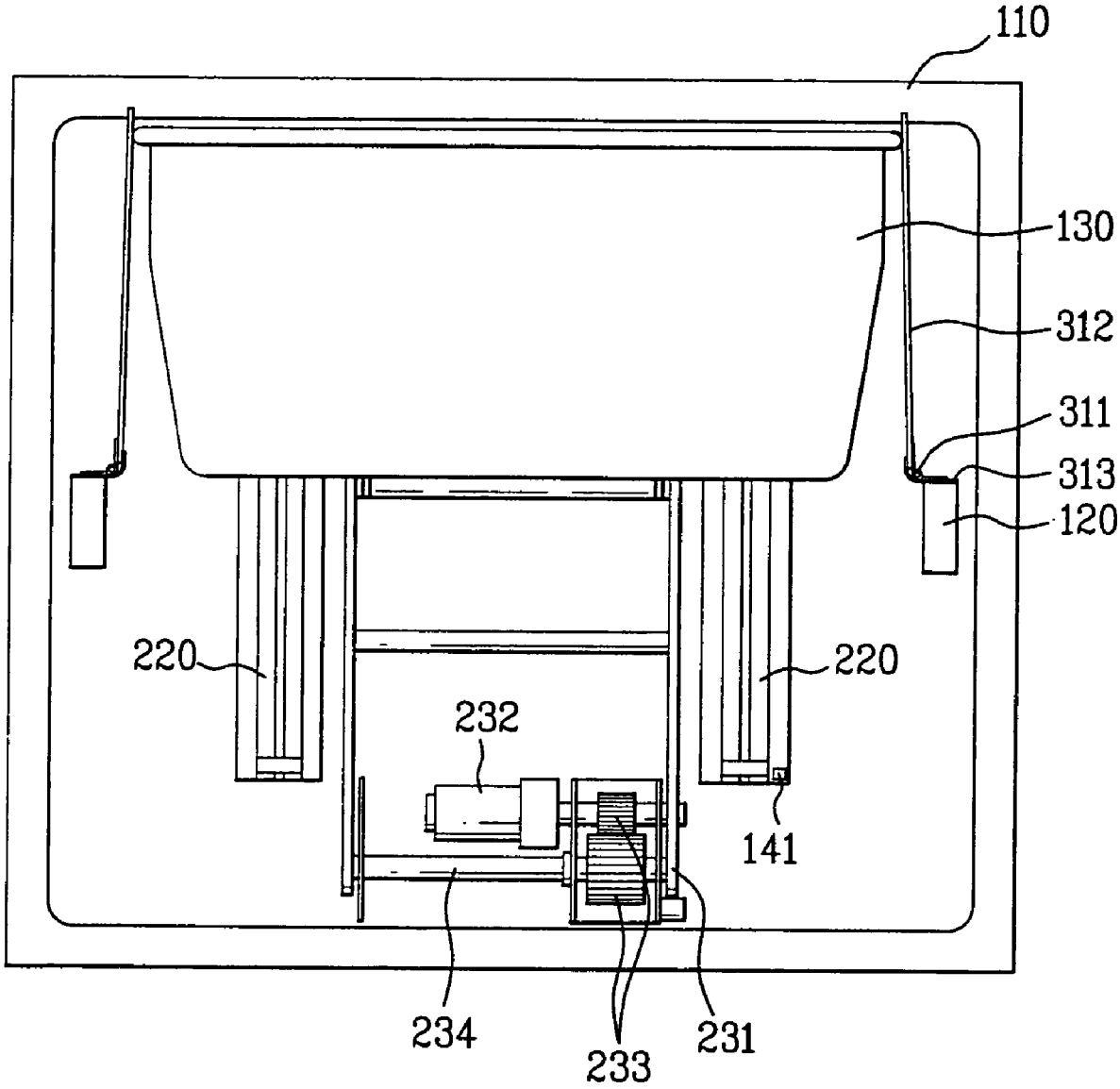
FIG. 6 illustrates a back side view showing a move-up state of the container of the lower door in FIG. 3.

As shown in FIG. 6, the container 130 has a rim at the top end of the container. The rim of the container 130 slides on a surface of the panel when the container 130 moves in the vertical direction. The rim of the container 130 is in contact with the surface of the panel 312.

In the illustrated embodiment, the panel 312 is substantially rectangular and mounted on each of opposite rail 120. The panel 312 covers the top of the container 130 when the container 130 moves down, and stands when the container 130 moves up, to cover a gap between a side surface of the container 130 and the rail 120.

Referring to FIG. 6, in the illustrated embodiment, a rotation angle of the panel 312 is within an acute angle with respect to the ground when the container 130 moves to a highest position.

In the illustrated embodiment, the panel 312 has a width 'W' the same as a side length of the container 130. Moreover, the panel 312 has a height 'H' enough to position the top-side end of the panel 312 higher than the top-side end of the container 130. The panel 312 stands substantially vertically when the container 130 moves up to the highest position. This can present the top-side end of the panel 312 from interfering with the top-side end of the container 130 when the container 130 moves down. If the top-side end of the panel 312 pivoted to stand vertically with respect to the ground is positioned lower than the top-side end of the container 130, the top-side end of the panel 312 will interfere with the top-side end of the container 130 when the container 130 moves down.

Moreover, it is preferable that the height 'H' of the panel 312 has a dimension enough to bring free ends of the left, and right side panels not into contact with each other when the container 130 moves down such that the panels 312 are over the top of the container 130 substantially parallel with the ground. This can prevent the panels 312 from interfering with each other. If the free ends of the left and right panels 312 interfere with each other when the container 130 moves down, the panels may fail to fold properly.

Moreover, it is preferable that the rotation angle of the hinge 311 is limited to be within 90° to prevent the panel 312 from turning over to an outer side during the pivoting. This can prevent the panel 312, which stands up when the container 130 moves up, from turning over to an outer side of the rail 120 beyond a vertical position with respect to the ground. If the panel 312 pivots to an obtuse angle, the automatic folding of the panels 312 fails when the container 130 moves down.

In the meantime, the height 'H' of the panel may be slightly larger than the maximum vertical moving distance of the container, such that the panel has a size varied with the maximum vertical moving distance of the container.

Figure 8:
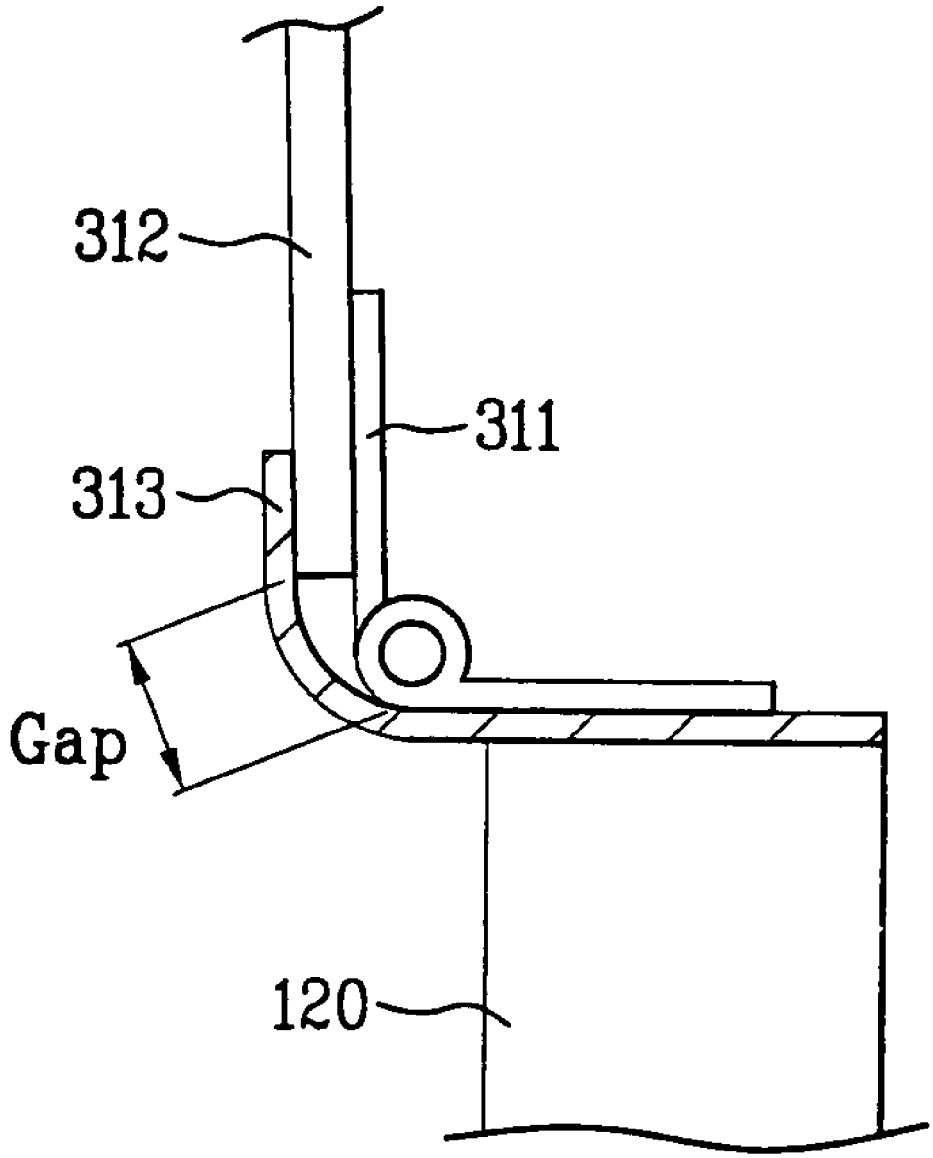
FIG. 8 illustrates a section of a joint of the panel and the rail in FIG. 3.

Referring to FIGS. 7 and 8, the safety device 300 in accordance with a preferred embodiment of the present invention further includes a gasket 313 which covers a gap between the panel 312 and the rail 120.

The panel 312 is fastened to the rail 120 with the hinge 311, and requires a predetermined gap to the rail 120 for providing a pivoting space. The gasket 313 covers the gap caused by the pivoting space between the panel and the rail.

The gasket 313 is attached to both a side of the panel 312 having the hinge 311 fastened thereto and the rail 120 to cover the gap between the panel 312 and the rail 120, thereby preventing object(s) from infiltrating through the gap. The gasket 313 has a first portion and a second portion. The first portion is located between the hinge 311 and the top surface of the rail 120. The second portion of the gasket 313 is attached to the panel 312 and bends when the panel 312 pivots.

Moreover, it is preferable that the gasket 313 is formed of a material bendable with the pivoting of the panel 312 and having a good durability on bending, such as soft rubber, or silicone.

It is preferable that the panel 312 has a plurality of cold air flow holes 312*a* so that the cold air can pass through the holes 312*a* from the inside of the refrigerator into the inside of the container 130. This is for smooth flowing of the cold air from the storage chamber to the inside of the container. It is preferable that the cold air flow hole 312*a* has a size which is not excessively large to prevent the object(s) from passing through the cold air flow hole 312*a*.

The operation of the refrigerator of the present invention will be described. When the user intends to put things in or take out things from the container 130, the user pulls the door 110 forward to draw out the door 110, and makes the container 130 to move up.

A power of the driving motor 232 is transmitted to the driving shaft 234 through the gear unit 233, and the driving arms 231 rotate upward by the rotation of the driving shaft 234.

When the driving arm 231 rotates upward, the roller 236 at the end of the driving arm 231 rolls along the underside of the lift 210. Therefore, the lift 210 moves up along the guide member 122, to lift the container 130 upward (see FIG. 3). At the same time, the panel 312 of the safety device pivots around the hinge 311.

When the lift 210 moves up to a position of the top sensor 141, the top sensor 141 provides a signal to the control panel to stop the moving driving motor 232, thereby stopping moving the lift 210 up.

In this instance, the roller 236 on the driving arm 231 passes a moderate slope of the move-down preventive step 211 until the roller 236 is positioned just in front of the move down preventive step 211 and stopped by the move-down preventive step 211. Therefore, downward rotation of the driving arm 231 is prevented by a load of the container 130 (see FIG. 3).

When rising of the container 130 is completed, each of the panels 312 is at an acute angle with respect to the ground and the top of the container 130 is open such that the user can put things in thereto or take out things therefrom, easily.

Moreover, since the panel 312 covers between the side of the container 130 and the rail 120, insertion of a hand or object(s) between the side of the container 130 and the rail 120 is prevented.

Figure 5:
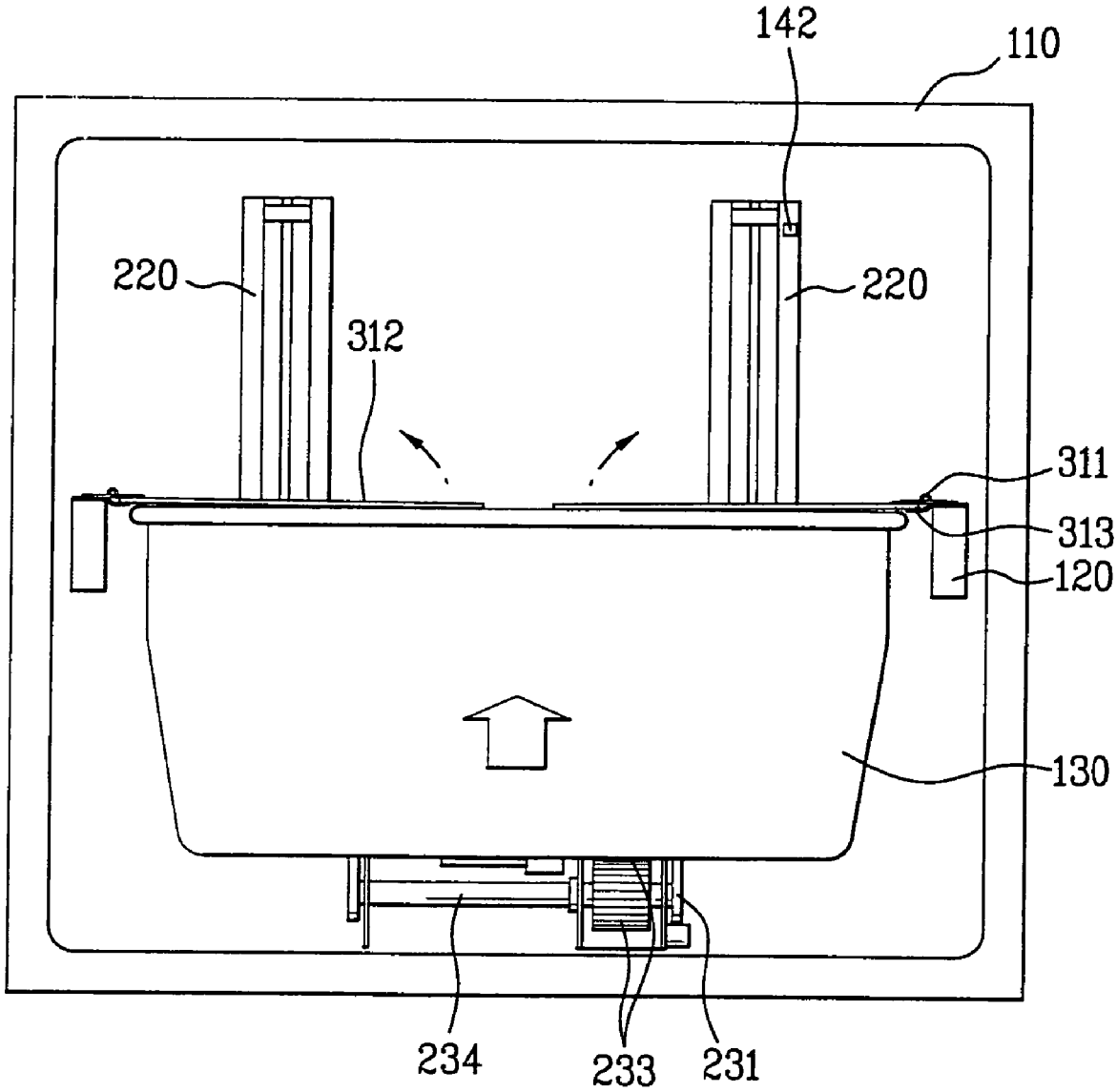
FIG. 5 illustrates a back side view showing a move-down state of the container of the lower door in FIG. 3.

Referring to FIG. 5, if the container 130 moves down after things are taken out of/put into the container 130, the panel 312 pivots downward following the down movement of the basket 130, to cover the top of the container 130 at the end. In this instance, since the panel covers the side of the container, insertion of a hand or object(s) between the side of the container 130 and the rail 120 is prevented.

The refrigerator of the present invention has the following advantages.

First, the automatic up/down movement of the container provides convenience to the user.

Second, the prevention of insertion of a hand or object(s) between the side of the container and the rail by the panel, preventing the appliance from being out of order, enhances the safety and reliability of the appliance.

Third, the cold air flow holes in the panel permit smooth supply of cold air to the inside of the container, even when the door is closed.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A refrigerator comprising:

a body having a storage space therein;

a door opening and shutting the storage space, the door being slidably movable with respect to the body;

rails arranged on the door for slidably guiding the door, each of the rails including a fixed rail member that is non-movable with respect to the door, each of the fixed rail members having a surface that is exposed when the door is in an open position and a shut position;

a container arranged in the storage space behind the door, a gap being between the container and at least one of the fixed rail members;

a moving unit connected to a rear surface of the door, the moving unit being configured to move the container in a vertical direction with respect to the rear surface of the door; and a safety device covering the gap and a portion of a top of the container when in a lower position, the safety device being connected to the exposed surface of one of the fixed rail members.

2. The refrigerator as claimed in claim 1, wherein the safety device comprises:

a hinge rotatably fastened to said at least one of the fixed rail members; and a panel fastened to the hinge, the panel pivoting when the container moves in the vertical direction to cover the gap.

3. The refrigerator as claimed in claim 2, wherein the hinge is fastened to a top surface of said at least one of the fixed rail members.

4. The refrigerator as claimed in claim 2, wherein the container has a rim at a top end of the container, the rim sliding on a surface of the panel when the container moves in the vertical direction.

5. The refrigerator as claimed in claim 4, the rim is in contact with the surface of the panel.

6. The refrigerator as claimed in claim 2, wherein the panel covers the top of the container when the container moves down.

7. The refrigerator as claimed in claim 2, wherein a rotation angle of the hinge is within a range of an acute angle.

8. The refrigerator as claimed in claim 2, wherein the safety device further includes a gasket for covering a gap between the panel and said at least one of the fixed rail members.

9. The refrigerator as claimed in claim 8, wherein the gasket has a first portion and a second portion, the first portion being located between the hinge and a top surface of said at least one of the fixed rail members.

10. The refrigerator as claimed in claim 9, wherein the second portion of the gasket is attached to the panel and bends when the panel pivots.

11. The refrigerator as claimed in claim 8, wherein the gasket is formed of a bendable material.

12. The refrigerator as claimed in claim 11, wherein the panel is formed of a material less flexible than the gasket.

13. The refrigerator as claimed in claim 2, wherein when the container moves up to a highest position, a top-side end of the panel is higher than a top-side end of the container.

14. The refrigerator as claimed in claim 2, wherein the panel comprises at least one hole for passing through cold air.

15. A refrigerator comprising:

a body having a storage space therein;

a door opening and shutting the storage space, the door being slidably movable with respect to the body;

rails arranged on the door for slidably guiding the door, each of the rails including a fixed rail member that is non-movable with respect to the door, each of the fixed rail members having a surface that is exposed when the door is in an open position and a shut position;

a container arranged in the storage space behind the door, a gap being between the container and at least one of the fixed rail members;

a moving unit connected to a rear surface of the door, the moving unit being configured to move the container in a vertical direction with respect to the rear surface of the door; and a safety device covering the gap between the container and said at least one of the fixed rail members when the container moves in the vertical direction, the safety device covering a top of the container when the container moves down, the safety device having at least one thorough hole for passing cold air into the container, and the safety device being connected to the exposed surface of one of the fixed rail members.

16. A refrigerator comprising:

a door movable in a first direction;

a moving unit connected to a rear surface of the door;

a container supported by the moving unit at the rear surface of the door such that the container is movable in the first direction and a second substantially perpendicular direction;

rails located on the door for slidably guiding the door in the first direction, each of the rails including a fixed rail member that is non-movable with respect to the door, each of the fixed rail members having a surface that is exposed when the door moves in the first direction, and a gap being between the container and at least one of the fixed rail members; and a safety device covering the gap and a portion of a top of the container when in a lower position, the safety device being connected to the exposed surface of one of the fixed rail members.

17. The refrigerator as claimed in claim 16, wherein the safety device pivots when the container moves in the second direction, the safety device including:

a hinge rotatably fastened to said at least one of the fixed rail members; and a panel fastened to the hinge, the panel pivoting when the container moves in the second direction to cover the gap.

18. The refrigerator as claimed in claim 17, wherein the container has a rim at a top end of the container, the rim sliding on a surface of the panel when the container moves in the second direction.

19. The refrigerator as claimed in claim 17, wherein the safety device further includes a gasket for covering a gap between the panel and said at least one of the fixed rail members.

20. The refrigerator as claimed in claim 17, wherein the second direction is a vertical direction, when the container moves up to a highest position, a top-side end of the panel being higher than a top-side end of the container.

21. The refrigerator as claimed in claim 2, wherein a second gap is located between the container and another fixed rail member of the fixed rail members, the refrigerator further comprising a second safety device, the second safety device including:

a second hinge rotatably fastened to said another fixed rail member of the fixed rail members; and a second panel fastened to the second hinge, the second panel pivoting when the container moves in the vertical direction to cover the second gap.

* * * * *